US005543281A

United States Patent [19]

Isaac et al.

[11] Patent Number: 5,543,281

[45] Date of Patent: Aug. 6, 1996

[54] MERCAPTOTETRAZOLE TRANSITION METAL SALTS FOR CONTROL OF CYAN STAIN

[75] Inventors: Walter H. Isaac, Penfield; Eric W. Wollman, Rochester, both of N.Y.

[73] Assignee: Eastman Kodak Company, Rochester, N.Y.

[21] Appl. No.: 390,464

[22] Filed: Feb. 17, 1995

[51] Int. Cl.[6] ..... G03C 1/775; G03C 7/392

[52] U.S. Cl. ..... 430/551; 430/611; 430/613; 430/618; 430/538

[58] Field of Search ..... 430/544, 551, 430/620, 611, 613, 618, 543, 552, 553, 538, 567

[56] References Cited

U.S. PATENT DOCUMENTS

| | | | |
|---|---|---|---|
| 2,432,864 | 12/1947 | Dimsdale et al. | 430/538 |
| 3,615,490 | 10/1971 | Gaffin | 430/350 |
| 3,620,749 | 11/1971 | Haist | 430/618 |
| 4,013,470 | 3/1977 | Landon, Jr. | 430/523 |
| 4,043,817 | 8/1977 | Okutsu et al. | 430/266 |
| 4,163,669 | 8/1979 | Kanada et al. | 430/393 |
| 4,732,846 | 3/1988 | Aono et al. | 430/620 |
| 4,772,545 | 9/1988 | Nishiyama et al. | 430/564 |
| 4,912,026 | 3/1990 | Miyoshi et al. | 430/546 |
| 4,923,784 | 5/1990 | Harder et al. | 430/620 |

FOREIGN PATENT DOCUMENTS

| | | |
|---|---|---|
| 3624606 | 7/1986 | Germany . |
| 3-37641 | 2/1991 | Japan . |

OTHER PUBLICATIONS

Derwent Abstract, Feb. 19, 1991, JP 03037641, p. 10.
ACS Abstract, JP 03037641, p. 2.

*Primary Examiner*—Lee C. Wright
*Attorney, Agent, or Firm*—Paul A. Leipold

[57] ABSTRACT

The invention relates to a photographic element comprising at least one layer comprising a transition metallic salt of the general formula:

AS-I wherein Q represents the atoms necessary to complete a five- or six-membered heterocyclic nucleus, and M is a transition metal cation and coupler, wherein said element further comprises silver chloride grains that comprise less than 2 mole percent iodide.

8 Claims, No Drawings

MERCAPTOTETRAZOLE TRANSITION METAL SALTS FOR CONTROL OF CYAN STAIN

FIELD OF THE INVENTION

This invention relates to the use of water insoluble salts of certain thiol compounds which have been found useful to prevent the occurrence of stain in the minimum density regions of color photographic elements after processing in a developer contaminated with bleach-fix solution.

BACKGROUND OF THE INVENTION

The-problem relates to the use of phenyl mercaptotetrazole (PMT) and derivatives in color paper photographic elements. While incorporation of PMT can be beneficial in reducing or eliminating cyan stain generated in developers contaminated by bleach-fix, it can also have a detrimental impact on what is termed "Wet Abrasion Sensitivity" (WAS).

The stain levels in color photographic paper prints vary with changes in the condition of the processing fluids in mechanical print processors. In particular, the cross-contamination of developer with bleach-fix can occur and causes increased stain. This stain is referred to as blix-induced stain. Color paper photographic elements which incorporate thiosulfonate addenda (for example, p-toluene thiosulfonate) to control heat sensitivity have been found to have an even worse blix-induced cyan stain problem.

We have found that the use of phenyl mercaptotetrazole (PMT) derivatives can reduce or eliminate the stain as long as the PMT or derivatives are added to the same layer as the thiosulfonate or are mobile enough to diffuse into the thiosulfonate containing layer from an adjacent layer. However, this solution is not always viable because of the Wet Abrasion Sensitivity concern, particularly in the magenta layer, described below.

Sometimes a plus or minus density mark is visible in the exposed region of a color print when pressure is applied to the emulsion in the first twenty seconds or so of immersion in the developer. This Wet Abrasion Sensitivity (WAS) problem is particularly acute for the magenta layer. We have found that the presence of phenyl mercaptotetrazole (PMT) in the magenta dispersion melts contributes to magenta layer WAS problems. PMT is used in the magenta layer to minimize "magenta dye streaking" but because of the WAS issue it would be preferable to remove it or replace it with a less mobile and a more hydrophobic derivative such as benzamidophenyl mercaptotetrazole (BAPMT). However, the removal of PMT or replacement by a addenda such as BAPMT in the magenta layer reintroduces the blix-induced cyan stain described earlier.

An obvious potential solution is the incorporation of PMT directly in the cyan layer. However, attempts to do this, either in the cyan dispersion or in the melt, have led to speed losses and melt hold stability concerns. Spectral sensitizers that are readily desorbed by competing addenda show larger speed losses than those red spectral sensitizers that are more tightly adsorbed to the grain surface.

U.S. Pat. No. 2,432,964 describes methods of making a solid particle dispersion of the AgPMT salt and also the photographic evaluation in which adverse effects on sensitivity are avoided and stain reduced, and U.S. Pat. No. 4,912,026 claims a combination of addenda, coupler solvent and gold sensitization.

PROBLEM TO BE SOLVED BY THE INVENTION

There is a continuing need for the elimination of cyan stain generated in developers contaminated by bleach/fix. There is further need for photographic elements that are not sensitive to wet abrasion sensitivity that causes deterioration of the print by pressure applied during development. There is a further need for the correction of these problems without generating speed losses in the photographic element or problems in stability of the melts prior to the formation of the photographic element or in storage of the photographic element prior to exposure.

SUMMARY OF THE INVENTION

The invention is performed by providing a photographic element comprising at least one layer comprising coupler and a transition metallic salt of the general formula:

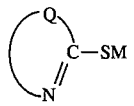

AS-I wherein Q represents the atoms necessary to complete a five- or six-membered heterocyclic nucleus, and M is a transition metal cation, wherein said element further comprises silver chloride grains that comprise less than 2 mole percent iodide.

In a further embodiment of the invention, there is provided a method of forming a photographic element wherein a coupler stream comprising a dispersion stream of coupler and a transition metallic salt of the general formula:

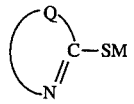

AS-I wherein Q represents the atoms necessary to complete a five- or six-membered heterocyclic nucleus, and M is a transition metal cation, and an emulsion stream comprising silver chloride are brought together immediately before coating.

ADVANTAGEOUS EFFECT OF THE INVENTION

We have found that incorporation of the transition metallic salt of certain heterocyclic thiols in the dispersion melt of a color photographic material results in lowered blix-induced cyan stain after processing while maintaining acceptable red speed and Wet Abrasion Sensitivity performance. Further, it has been found that use of these salts is also compatible with the use of thiosulfonate compounds, which have been found to be useful to control heat sensitivity of color paper multilayer elements. The invention further has the benefit of increased sensitivity.

DETAILED DESCRIPTION OF THE INVENTION

The cyan stain controlling compound is a transition metallic salt of a heterocyclic compound containing S, O, and/or N heteroatoms, preferably in a five- or six-membered heterocyclic compound with 2–4 heteroatoms and has a pKsp value of 13–20. The transition metallic salt of the heterocyclic mercaptans is represented by the general formula:

AS-I

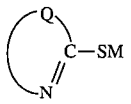

wherein Q represents the atoms necessary to complete a five or six membered heterocyclic nucleus, and M is a transition metal cation. Preferred heterocyclic nuclei include tetrazoles, triazoles, imidazoles, oxadiazoles, thiadiazoles and benzothiazoles.

In a preferred embodiment, the antistain compound has one of the following structures:

AS-Ia

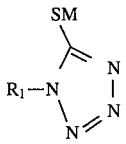

AS-Ib

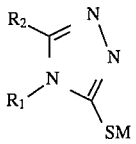

AS-Ic

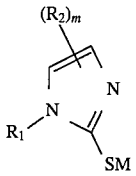

AS-Id

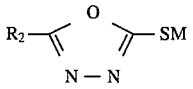

AS-Ie

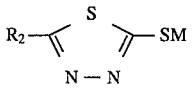

AS-If

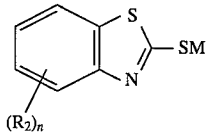

wherein M is a transition metal; $R_1$ is selected from hydrogen, alkyl, aryl, carbonamido, sulfonamido, alkenyl, cycloalkyl, cycloalkenyl, alkinyl, sulfonyl, sulfinyl, phosphonyl, acyl, carbamoyl, sulfamoyl, amino, alkylamino, anilino, imido, ureido, sulfamoylamino, alkoxycarbonylamino, aryloxycarbonylamino, alkoxycarbonyl, aryloxycarbonyl; $R_2$ is selected from the same substituents as $R_1$ and halogen, alkoxy, aryloxy, siloxy, acyloxy, carbamoyloxy; or $R_1$ and $R_2$ can be any combination of substituents sufficient to obtain a pKsp value between 13–20; m=0–2; and n=0–4. The metal ion is one that can be removed from the antistain compound and form a salt by reaction with the halide ion which is released during development, or with any other compound in the photographic element before or during processing. Preferably M is selected from Ag, Au, Cu, Ni, Pd, Zn, Rh, Pt and Pb. The material preferably contains $1\times10^{-5}$ to 1.0 g/m$^2$ of antistain compound AS-I in the photographic element.

In a more preferred embodiment, the compound is Ag salt of a derivative of phenyl mercaptotetrazole, AS-Ig, where $R_2$ is selected from alkyl, aryl, alkylcarbonamido, and arylcarbonamido and n=0–2. The Ag salt of phenyl mercaptotetrazole (AZ-Ig-1, n=0) is most preferred salt.

AS-Ig

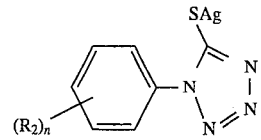

In a preferred embodiment, the silver salt of phenyl mercaptotetrazole (AgPMT) is incorporated in the cyan dispersion melt of color photographic paper and results in low blix-induced cyan stain after processing while maintaining acceptable red speed and Wet Abrasion Sensitivity performance.

It has also been found advantageous to use the invention cyan stain controlling compound in combination with a heterocyclic mercaptan compound in the green layer of the color photographic element, said heterocyclic compound containing S, O, and/or N heteroatoms, preferably in a five- or six-membered heterocyclic compound with 2–4 heteroatoms. The heterocyclic mercaptans of the invention are represented by the general formula:

AF-I

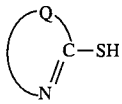

wherein Q represents the atoms necessary to complete a five- or six-membered heterocyclic nucleus and provided that when AF-I is phenyl mercaptotetrazole, the calculated partition coefficient (clog P) is at least 2.0, and preferably at least 2.5. Exemplary preferred heterocyclic nuclei include tetrazoles, triazoles, imidazoles, oxadiazoles, thiadiazoles and benzothiazoles.

The calculated partition coefficient (clog P) is a measure of relative hydrophobicity of a molecule. The higher the clog P, the greater the hydrophobicity and the lower the waiter solubility the molecule. The values for clog P can be calculated using the MedChem program, available from the Medicinal Chemistry Project, Pomona College, Claremont, Calif.

In a preferred embodiment, the mercaptan compound has one of the following structures:

AF-Ia

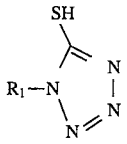

AF-Ib

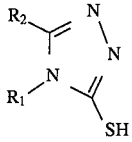

AF-Ic

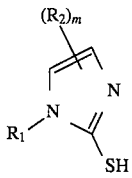

-continued

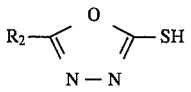

AF-Id

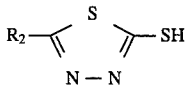

AF-Ie

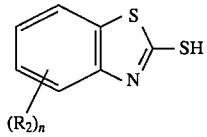

AF-If wherein $R_1$ is selected from hydrogen, alkyl, aryl, carbonamido, sulfonamido, alkenyl, cycloalkyl, cycloalkenyl, alkinyl, sulfonyl, sulfinyl, phosphonyl, acyl, carbamoyl, sulfamoyl, amino, alkylamino, anilino, imido, ureido, sulfamoylamino, alkoxycarbonylamino, aryloxycarbonylamino, alkoxycarbonyl, aryloxycarbonyl; $R_2$ is selected from the same substituents as $R_1$ and halogen, alkoxy, aryloxy, siloxy, acyloxy, carbamoyloxy; m=0–2; and n=0–4. In another embodiment, the compound is the Ag salt of a derivative of the mercaptoheterazoles listed in Agfa Research Disclosure 24236 (June 1984) p. 274–278, and Research Disclosure 29759 (January 1989) p. 45–50; U.S. Pat. No. 4,912,026, columns 16–24 (Konishiroku); and U.S. Pat. No. 5,244,779, columns 13–28.

In addition, it has been found beneficial to use the invention compound AS-I in combination with a thiosulfonate salt of the following general structure:

$$R_aSO_2SM_a \qquad \text{AF-II}$$

wherein $R_a$ is selected from alkyl, aryl, heteroaryl, and arylalkyl substituents. Additionally, $R_a$ may comprise part of a polymeric backbone wherein the thiosulfonate moiety is repeated. $M_a$ may be any of the monovalent metal or tetraalkylammonium cations.

These thiosulfonate compounds are generally used in conjunction with sulfinate addenda. In particular, it would be advantageous to use AF-II in conjunction with compounds of the general structure AF-III:

$$R_bSO_2M_b \qquad \text{AF-III}$$

wherein $R_b$ is selected from alkyl, aryl, heteroaryl, and arylalkyl substituents. Additionally, $R_b$ may comprise part of a polymeric backbone wherein the thiosulfinate moiety is repeated. $M_b$ may be any of the monovalent metal or tetraalkylammonium cations.

In a more preferred embodiment, AgPMT is used in combination with p-toluene thiosulfonate and p-toluene sulfinate for improved blix-induced stain and heat sensitivity control.

It has been found that using AgPMT in the cyan emulsion melt results in the melt hold speed losses. Therefore, in a preferred embodiment, AgPMT is incorporated in the red layer via addition to the cyan dispersion melt.

In a most preferred embodiment, AgPMT is incorporated into the photographic element in the cyan dispersion, and is used in conjunction with salts of p-toluene thiosulfonate and p-toluene sulfinate (also in the red layer) and a hydrophobic derivative of PMT (such as BAPMT) which is used in the green layer. This method of use results in elimination of the blix-induced cyan stain and gives good WAS performance.

Typically, the photographic materials are incorporated in a silver halide emulsion and the emulsion coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkyithio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

It is understood throughout the description of this invention that any reference to a substituent by the identification of a group containing a substitutable hydrogen (e.g., alkyl, amine, aryl, alkoxy, and heterocyclic) unless otherwise specifically stated, shall encompass not only the substituent's unsubstituted form, but also its form substituted with any photographically useful substituents. Usually the substituent will have less than 30 carbon atoms and typically less than 20 carbon atoms. Typical examples of substituents include alkyl, aryl, anilino, carbonamido, sulfonamido, alkylthio, arylthio, alkenyl, cycloalkyl, and further to these exemplified are halogen, cycloalkenyl, alkinyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, inter-layers, overcoat layers, subbing layers, and the like.

In the following discussion of suitable materials for use in the emulsions and elements that can be used in conjunction with this invention, reference will be made to Research Disclosure, September 1994, Item 36544, published by Kenneth Mason Publications, Ltd., Dudley House, 12 North Street, Emsworth, Hampshire P010 7DQ, England, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in these photographic elements can be either negative-working or positive-working. Suitable emulsions and their preparation, as well as methods of chemical and spectral sensitization, are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

It is further desired to utilize aspects of the invention in combination with the materials described in Research Disclosure, February 1995, Volume 370 in an article entitled "Preferred Color Paper, Color Negative, and Color Reversed Photographic Elements and Processing". In particular, elements of the invention could be advantageously used in combination with couplers as described in Section II, various addenda as decribed in Sections III–XIII and XV–XVI, in photographic elements such as described in XVII and XVIII, and processed as described in Section XXIII.

Due to a desire for rapid development, preferred emulsions for color paper are high in silver chloride. Typically, silver halide emulsions with greater than 90 mole % chloride are preferred, and even more preferred are emulsions of greater than 95 mole % chloride. In some instances, silver chloride emulsions containing small amounts of bromide, or iodide, or bromide and iodide are preferred, generally less than 5.0 mole % of bromide less than 2.0 mole % of iodide. Bromide or iodide addition when forming the emulsion may come from a soluble halide source such as potassium iodide or sodium bromide or an organic bromide or iodide or an inorganic insoluble halide such as silver bromide or silver iodide. Soluble bromide is also typically added to the emulsion melt as a keeping addendum. In addition, it is specifically contemplated to use elements of the invention in combination with [100] tabular grain silver chloride emulsions such as described in U.S. Pat. No. 5,320,938.

Color paper elements typically contain less than 0.80 $g/m^2$ of total silver. Due to the need to decrease the environmental impact of color paper processing, it is desired to decrease the amount of total silver used in the element as much as possible. Therefore, total silver levels of less than 0.65 $g/m^2$ are preferable, and levels of 0.55 $g/m^2$ are even more preferable. It is possible to reduce further the total silver used in the color paper photographic element to less than 0.10 $g/m^2$ by use of a so-called development amplication process whereby the incorporated silver is used only to form the latent image, while another oxidant, such as hydrogen peroxide, serves as the primary oxidant to react with the color developer. Such processes are well known to the art, and are described in, for example, U.S. Pat. Nos. 4,791,048; 4,880,725; and 4,954,425; EP 487,616; International published patent application Nos. WO 90/013,059; 90/013,061; 91/016,666; 91/017,479; 92/001,972; 92/005,471; 92/007,299; 93/001,524; 93/011,460; and German published patent application OLS 4,211,460. It would be particularly advantageous to use elements of this invention in combination with a low silver color paper designed for the RX process.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 92/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

Preparation of compounds of the general formula AS-I from compounds of the general formula AF-I is described below. Compounds of general formula AF-I can be made as described in, for example, U.S. Pat. Nos. 2,403,927; 3,266,897; 3,397,987; 3,364,028; 3,708,303; 4,804,623; Research Disclosure, Vol. 116, December 1973, Item 11684; and EP 330,018 and EP 564,281. The preparation of compounds of the general formula AF-II may be found in, for instance, Chem. Lett. 1987, 11, 2161; Organic Syntheses Colective Volume VI, 1988, p. 1016; Organic Syntheses, 1974, 54, 33; and J. Org. Chem.1986, 51, 5235. Sulfinates of the general structure AF-III may be obtained commercially or can be obtained by reduction of the corresponding sulfonyl chlorides.

EXAMPLE 1

Silver chloride emulsions were chemically and spectrally sensitized as is described below.

Blue Sensitive Emulsion (Blue EM-1, prepared similarly to that described in U.S. Pat. No. 5,252,451, column 8, lines 55–68): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a precipitation without dopant. The resultant emulsion contained cubic shaped grains of 0.76 μm in edge length size. This emulsion was optimally sensitized by the addition of a colloidal suspension of aurous sulfide and heat ramped up to 60° C. during which time blue sensitizing dye BSD-1, 1-(3-acetamidophenyl)-5-mercaptotetrazole and potassium bromide were added. In addition, iridium dopant was added during the sensitization process.

Green Sensitive Emulsion (Green EM-1): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. Iridium dopant was added during the late stage of grain formation. The resultant emulsion contained cubic shaped grains of 0.30 μm in edge length size. This emulsion was optimally sensitized by addition of green sensitizing dye GSD-1, a colloidal suspension of aurous sulfide, heat digestion followed by the addition of 1-(3-acetamidophenyl)-5-mercaptotetrazole and potassium bromide.

Red Sensitive Emulsion (Red EM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μm in edge length size. This emulsion was optimally sensitized by the addition of a colloidal suspension of aurous sulfide followed by a heat ramp, and further additions of 1-(3-acetamidophenyl)-5-mercaptotetrazole, potassium bromide and red sensitizing dye RSD-1. In addition, iridium dopant was added during the sensitization process.

As set forth in Tables I and II below, Examples P-1 to P-6 were coated to form photographic elements. Coupler dispersions were emulsified by methods well known to the art. Samples P-1 to P-6 were coated on a polyethylene resin coated paper support, that was sized as described in U.S. Pat. No. 4,994,147 and pH adjusted as described in U.S. Pat. No. 4,917,994. The polyethylene layer coated on the emulsion side of the support contained a mixture of 0.1% (4,4'-bis(5-methyl-2-benzoxazolyl)stilbene and 4,4'-bis(2-benzoxazolyl)stilbene, 12.5% $TiO_2$, and 3% ZnO white pigment. The layers were hardened with bis(vinylsulfonyl methyl) ether at 1.95% of the total gelatin weight.

TABLE I

| Example | P-1 | P-2 | P-3 | P-4 | P-5 | P-6 |
|---|---|---|---|---|---|---|
| Comment | Prior Art | Prior Art | Prior Art | Invention | Prior Art | Invention |
| Overcoat | S-1 | S-1 | S-1 | S-1 | S-1 | S-1 |
| UV Layer | UV-1 | UV-1 | UV-1 | UV-1 | UV-2 | UV-2 |
| Red Layer | R-1 | R-1 | R-2 | R-3 | R-4 | R-5 |
| UV Layer | UV-1 | UV-1 | UV-1 | UV-1 | UV-2 | UV-2 |
| Green Layer | G-1 | G-2 | G-1 | G-1 | G-3 | G-3 |
| Interlayer | IL-1 | IL-1 | IL-1 | IL-1 | IL-1 | IL-1 |
| Blue Layer | B-1 | B-1 | B-1 | B-1 | B-1 | B-1 |

TABLE II

| Layer | Description of Formulation |
|---|---|
| S-1 | • 1.076 g/m$^2$ of gelatin<br>• 0.027 g/m$^2$ of polydimethylsiloxane<br>• 0.009 g/m$^2$ of SF-1<br>• 0.004 g/m$^2$ of SF-2<br>• 0.003 g/m$^2$ of Tergitol 15-S-5 ™<br>• 0.018 g/m$^2$ of Dye-1<br>• 0.009 g/m$^2$ of Dye-2<br>• 0.007 g/m$^2$ of Dye-3 |
| UV-1 | • 0.63 g/m$^2$ of gelatin<br>• 0.27 g/m$^2$ of UVA-2<br>• 0.05 g/m$^2$ of UVA-1<br>• 0.04 g/m$^2$ of dioctyl hydroquinone<br>• 0.11 g/m$^2$ of 1,4-cyclohexylenedimethylene bis(2-ethylhexanoate) |
| UV-2 | • 0.484 g/m$^2$ of gelatin<br>• 0.159 g/m$^2$ of UVA-2<br>• 0.028 g/m$^2$ of UVA-1<br>• 0.038 g/m$^2$ of dioctyl hydroquinone<br>• 0.062 g/m$^2$ of 1,4-cyclohexylenedimethylene bis(2-ethylhexanoate) |
| R-1 | • 1.087 g/m$^2$ of gelatin<br>• 0.210 g/m$^2$ of red sensitive silver (Red EM-1)<br>• 0.424 g/m$^2$ of C-1<br>• 0.232 g/m$^2$ of dibutyl phthalate<br>• 0.034 g/m$^2$ of 2-(2-butoxyethoxy)ethyl acetate<br>• 0.003 g/m$^2$ of potassium tolylthiosulfonate<br>• 0.0003 g/m$^2$ of potassium tolylsulfinate |

TABLE II-continued

| Layer | Description of Formulation |
|---|---|
| R-2 | • 1.087 g/m$^2$ of gelatin<br>• 0.210 g/m$^2$ of red sensitive silver (Red EM-1)<br>• 0.424 g/m$^2$ of C-1<br>• 0.232 g/m$^2$ of dibutyl phthalate<br>• 0.034 g/m$^2$ of 2-(2-butoxyethoxy)ethyl acetate<br>• 0.003 g/m$^2$ of potassium tolylthiosulfonate<br>• 0.0003 g/m$^2$ of potassium tolylsulfinate<br>• 0.00108 g/m$^2$ of 1-phenyl-5-mercaptotetrazole |
| R-3 | • 1.087 g/m$^2$ of gelatin<br>• 0.210 g/m$^2$ of red sensitive silver (Red EM-1)<br>• 0.424 g/m$^2$ of C-1<br>• 0.232 g/m$^2$ of dibutyl phthalate<br>• 0.034 g/m$^2$ of 2-(2-butoxyethoxy)ethyl acetate<br>• 0.003 g/m$^2$ of potassium tolylthiosulfonate<br>• 0.0003 g/m$^2$ of potassium tolylsulfinate<br>• 0.00108 g/m$^2$ of 1-phenyl-5-mercaptotetrazole from IP-1 |
| R-4 | • 1.389 g/m$^2$ of gelatin<br>• 0.187 g/m$^2$ of red sensitive silver (Red EM-1)<br>• 0.424 g/m$^2$ of C-1<br>• 0.272 g/m$^2$ of UVA-2<br>• 0.414 g/m$^2$ of dibutyl phthalate<br>• 0.035 g/m$^2$ of 2-(2-butoxyethoxy)ethyl acetate<br>• 0.003 g/m$^2$ of potassium tolylthiosulfonate<br>• 0.0003 g/m$^2$ of potassium tolylsulfinate |
| R-5 | • 1.389 g/m$^2$ of gelatin<br>• 0.187 g/m$^2$ of red sensitive silver (Red EM-1)<br>• 0.424 g/m$^2$ of C-1<br>• 0.272 g/m$^2$ of UVA-2<br>• 0.414 g/m$^2$ of dibutyl phthalate<br>• 0.035 g/m$^2$ of 2-(2-butoxyethoxy)ethyl acetate<br>• 0.003 g/m$^2$ of potassium tolylthiosulfonate<br>• 0.0003 g/m$^2$ of potassium tolylsulfinate<br>• 0.00054 g/m$^2$ of 1-phenyl-5-mercaptotetrazole from IP-1 |
| G-1 | • 1.270 g/m$^2$ of gelatin<br>• 0.234 g/m$^2$ of green sensitive silver (Green EM-1)<br>• 0.389 g/m$^2$ of M-1<br>• 0.195 g/m$^2$ of dibutyl phthalate<br>• 0.058 g/m$^2$ of 2-(2-butoxyethoxy)ethyl acetate<br>• 0.166 g/m$^2$ of ST-1<br>• 0.039 g/m$^2$ of dioctyl hydroquinone |
| G-2 | • 1.270 g/m$^2$ of gelatin<br>• 0.234 g/m$^2$ of green sensitive silver (Green EM-1)<br>• 0.389 g/m$^2$ of M-1<br>• 0.195 g/m$^2$ of dibutyl phthalate<br>• 0.058 g/m$^2$ of 2-(2-butoxyethoxy)ethyl acetate<br>• 0.166 g/m$^2$ of ST-1<br>• 0.039 g/m$^2$ of dioctyl hydroquinone<br>• 0.00108 g/m$^2$ of 1-phenyl-5-mercaptotetrazole |
| G-3 | • 1.270 g/m$^2$ of gelatin<br>• 0.234 g/m$^2$ of green sensitive silver (Green EM-1)<br>• 0.389 g/m$^2$ of M-1<br>• 0.195 g/m$^2$ of dibutyl phthalate<br>• 0.058 g/m$^2$ of 2-(2-butoxyethoxy)ethyl acetate<br>• 0.166 g/m$^2$ of ST-1 |

TABLE II-continued

| Layer | Description of Formulation |
|---|---|
| | • 0.039 g/m$^2$ of dioctyl hydroquinone |
| | • 0.0018 g/m$^2$ of 1-(3-benzamidophenyl)-5-mercaptotetrazole . |
| G-4 | • 1.259 g/m$^2$ of gelatin |
| | • 0.145 g/m$^2$ of green sensitive silver (Green EM-2) |
| | • 0.258 g/m$^2$ of M-2 |
| | • 0.568 g/m$^2$ of tris(2-ethylhexyl)phosphate |
| | • 0.348 g/m$^2$ of ST-2 |
| | • 0.426 g/m$^2$ of ST-3 |
| | • 0.173 g/m$^2$ of dioctyl hydroquinone |
| | • 0.001 mg/m$^2$ of BIO-1 |
| | • 0.001 g/m$^2$ of 1-(3-(2-hydroxy)-benzamidophenyl)-5-mercaptotetrazole |
| IL-1 | • 0.753 g/m$^2$ of gelatin |
| | • 0.094 g/m$^2$ of dioctyl hydroquinone |
| | • 0.282 g/m$^2$ of dibutyl phthalate |
| | • 0.065 g/m$^2$ of 4,5 dihydroxy-m-benzene-disulfonate |
| | • 0.002 g/m$^2$ of SF-1. |
| B-1 | • 1.530 g/m$^2$ of gelatin |
| | • 0.280 g/m$^2$ of blue sensitive silver (Blue EM-1) |
| | • 1.080 g/m$^2$ of Y-1 |
| | • 0.260 g/m$^2$ of dibutyl phthalate |
| | • 0.260 g/m$^2$ of 2-(2-butoxyethoxy)ethyl acetate |
| | • 0.002 g/m$^2$ of 2,5-dihydroxy-5-methyl-3-(1-piperidinyl)-2-cyclopenten-1-one |
| B-2 | • 1.528 g/m$^2$ of gelatin |
| | • 0.253 g/m$^2$ of blue sensitive silver (Blue EM-1) |
| | • 0.484 g/m$^2$ of Y-2 |
| | • 0.330 g/m$^2$ of dibutyl phthalate |
| | • 0.260 g/m$^2$ of ST-4 |
| | • 0.009 g/m$^2$ of ST-5 |
| | • 0.002 g/m$^2$ of 2,5-dihydroxy-5-methyl-3-(1-piperidinyl)-2-cyclopenten-1-one |

Preparation of IP-1

1. Prepare solution 1 by dissolving 13.73 moles of $AgNO_3$ in 79.5 liter of distilled water.

2. Prepare solution 2 by dissolving 6.82 moles of 1-phenyl-5-mercaptometrazole in 88 liter of methanol.

3. Prepare kettle with 112.7 L distilled water and 241.7 g/l gel.

4. At 43° C. double jet precipitate to the surface using solution 1 at 15.9 L/min for 5 min. and solution 2 at 17.6 L/min for 5 min, into the kettle with gel and water of 3.

5. Adjust melt gel content to 13.3% and final melt weight to 820 kg with gel and distilled water.

Wet Abrasion Sensitivity Measurement (WAS)

Photographic elements P-1 to P-6 were exposed and processed through KODAK EKTACOLOR RA processing chemistry. Approximately 10 seconds into the developer, an increasing amount of mass was applied to a 0.063 inch diameter stylus that was run over the emulsion side of the photographic element. The amount of weight required to form a visible mark was recorded and is shown in Table III.

Bleach-Fix Induced Stain Measurement

Unexposed samples of P-1 to P-6 were processed through KODAK EKTACOLOR RA processing chemistry in the conventional manner. Another strip of the sample was processed in a similar process, except that the developer was contaminated with 2.4 mL of KODAK EKTACOLOR RA Bleach-Fix per liter of developer. The amount of unwanted stain was calculated by subtracting the amount of red density found in the normal process from the red density found in the contaminated process (see Table III).

Relative Speed Measurement

The coatings were exposed through a step tablet and then were processed through the KODAK EKTACOLOR RA process. The relative speed (Log E) of the red emulsion was measured and is shown in Table III.

TABLE III

| Example | P-1 | P-2 | P-3 | P-4 | P-5 | P-6 |
|---|---|---|---|---|---|---|
| Comment | Prior Art | Prior Art | Prior Art | Invention | Prior Art | Invention |
| AgPMT/Ag (mmol/mol) | None | None | None | 3.6 | None | 1.8 |
| AgPMT Location | — | — | — | Cyan Disper. | — | Cyan Disper. |
| Antifoggant | None | PMT | PMT | None | BAPMT | BAPMT |
| Antifoggant Location | — | Magenta Disper. | Cyan Disper. | — | Magenta Disper. | Magenta Disper. |
| WAS | 20 | 10 | 20 | 20 | 20 | 20 |
| Red Speed | 1.92 | 1.90 | 1.52 | 1.92 | 1.82 | 1.86 |
| Red Stain | 0.24 | 0.12 | 0.11 | 0.12 | 0.33 | 0.11 |

Table Notes: PMT is 1-phenyl-5-mercaptotetrazole and BAPMT is 1-(3-benzamidophenyl)-5-mercaptotetrazole.

As can be seen in Table III, when no PMT is present (P-1), there is unwanted red stain. If PMT is placed in the magenta dispersion (P-2), WAS is degraded. When PMT is included in the cyan dispersion (P-3), WAS performance is improved; however, red speed is significantly reduced. Example P-4 shows that when PMT is removed from the element, acceptable WAS performance and red speed are obtained. However, it has been seen that when the color paper is developed in certain automatic processors, magenta dye streaking can be a problem with elements like P-4. Use of BAPMT (P-5) leads to acceptable magenta dye streaking, WAS, and red speed performance; however, blix-induced red stain is compromised. Element P-6 shows that when a compound of the invention is included in combination with a more hydrophobic derivative of PMT (i.e., BAPMT), acceptable performance is achieved for all of the parameters.

EXAMPLE 2

Green Sensitive Emulsion (Green EM-2): A high chloride silver halide emulsion was prepared in a manner somewhat similar to that described for Green EM-1.

A color photographic multilayer element is prepared by coating dispersions on a paper support, as was described above. The composition of the element is as described in Table IV below. Element P-7 is processed as described previously, and performance similar to element P-6 is obtained.

TABLE IV

| Example | P-7 |
|---|---|
| Comment | Invention |
| Overcoat | S-1 |
| UV Layer | UV-2 |
| Red Layer | R-5 |
| UV Layer | UV-2 |
| Green Layer | G-4 |
| Interlayer | IL-1 |
| Blue Layer | B-2 |

Structures

BSD-1

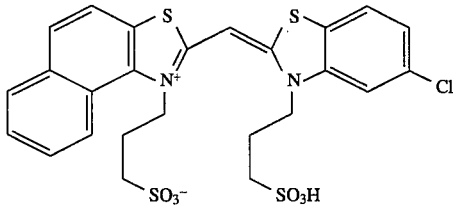

GSD-1

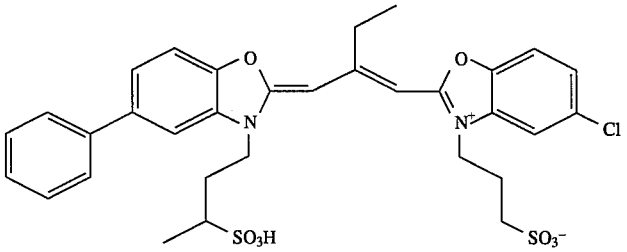

RSD-1

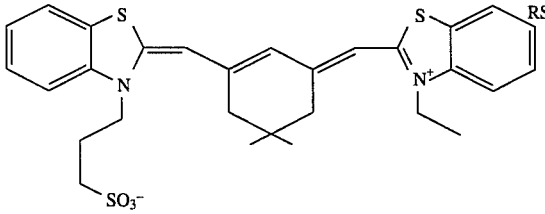

UVA-1

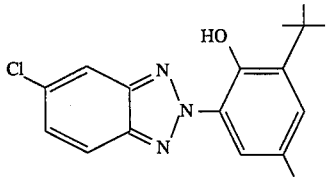

UVA-2

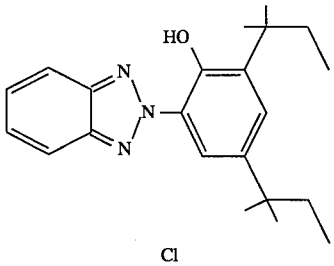

C-1

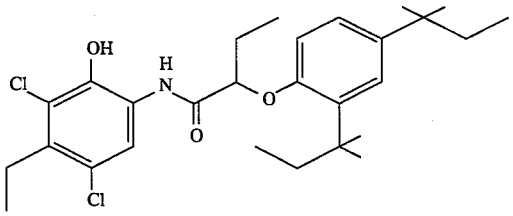

M-1

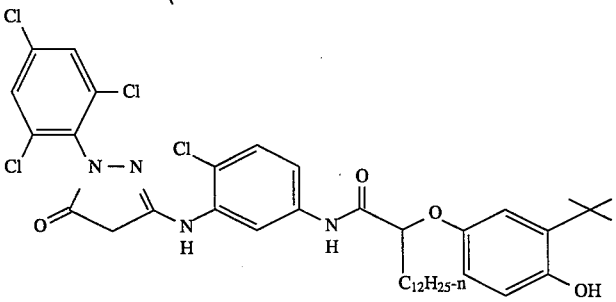

-continued
Structures
M-2
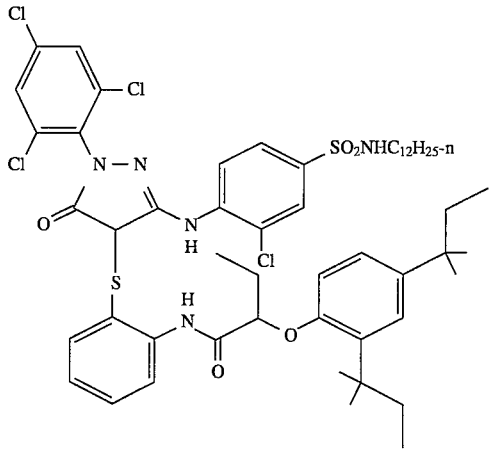
Y-1
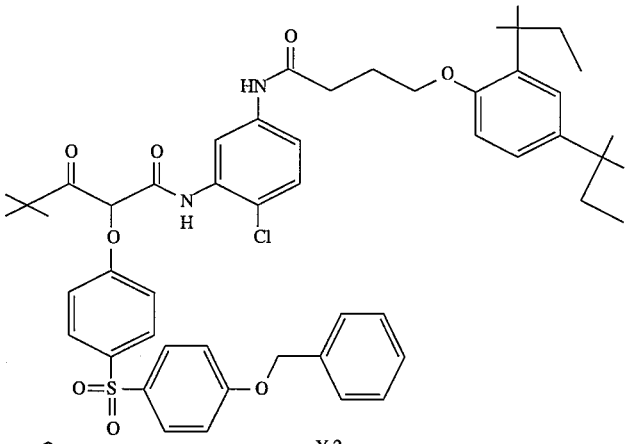
Y-2
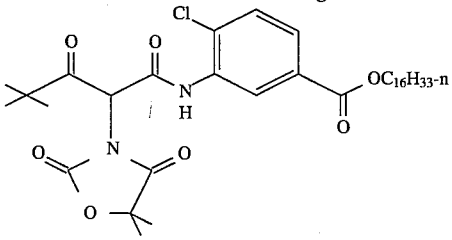
ST-1
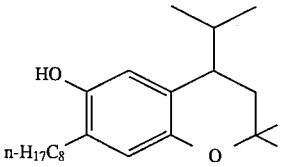
ST-2
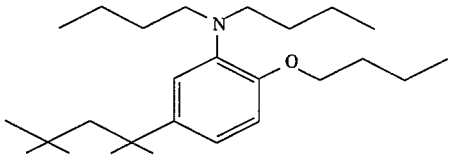
ST-3
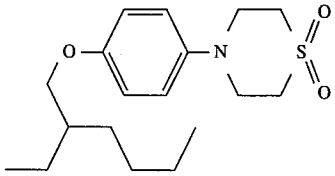
ST-4
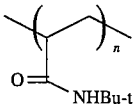
n = 75–8,000
ST-5
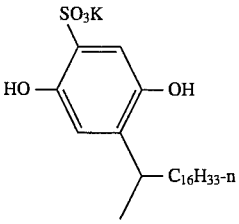

-continued

Structures

SF-1

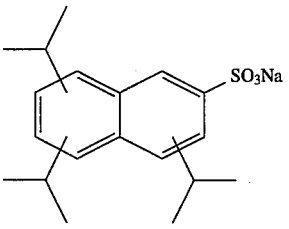

$CF_3.(CF_2)_7.SO_3Na$ SF-2

DYE-1

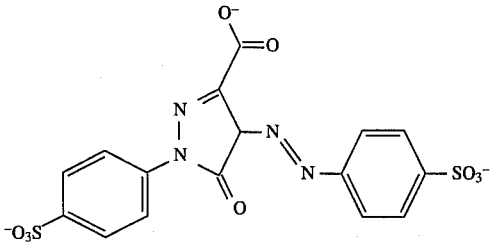

DYE-2

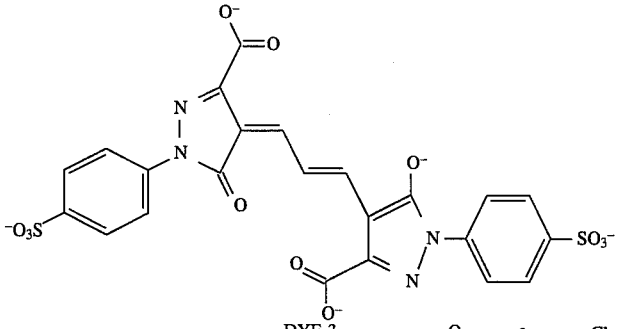

DYE-3

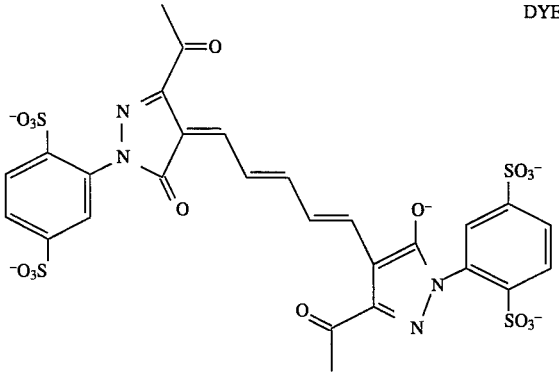

BIO-1

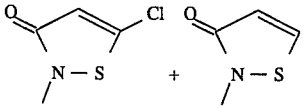

The invention has been described in detail with particular reference to preferred embodiments thereof, but it will be understood that variations and modifications can be effected within the spirit and scope of the invention.

We claim:

1. A photographic element comprising a color photographic paper wherein said paper comprises at least one layer comprising dye-forming coupler, a transition metallic salt of the general formula:

AS-Ig

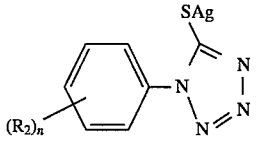

wherein $R_2$ is selected from alkyl, aryl, alkylcarbonamido and arylcarbonamido, and n=0–2, silver chloride grains that comprise less than 2 mole percent iodide, and a thiosulfonate salt $R_aSO_2SM_a$ AF-II wherein $R_a$ is selected from alkyl, aryl, heteroaryl, and arylalkyl substituents or $R_a$ may comprise part of a polymeric backbone wherein the thiosulfonate moiety is repeated, and $M_a$ is a monovalent metal or tetraalkylammonium cation.

2. The element of claim 1 wherein said transition metallic salt comprises 0.05 to 20 millimoles per silver mole.

3. The element of claim 1 wherein said at least one layer comprises the cyan layer.

4. The element of claim 1 wherein said thiosulfonate salt is in the cyan layer.

5. The element of claim 1 wherein said silver chloride grains comprise up to 5 percent bromide.

6. The element of claim 1 further comprising the sulfinate $R_bSO_2M_b$ AF-III wherein $R_b$ is selected from alkyl, aryl, heteroaryl, and arylalkyl substituents or $R_b$ may comprise part of a polymeric backbone wherein the thiosulfinate moiety is repeated and $M_b$ is a monovalent metal or tetraalkylammonium cation.

7. The element of claim 6 wherein the thiosulfonate salt is a salt of p-toluene thiosulfonate and the sulfinate is p-toluene sulfinate.

8. The element of claim 6 wherein said at least one layer comprises the cyan layer.

* * * * *